United States Patent [19]

Pearce

[11] 4,173,188

[45] Nov. 6, 1979

[54] COAL FIRING SYSTEMS FOR KILNS

[76] Inventor: Philip D. Pearce, P.O. Box 272, Pleasant Garden, N.C. 27313

[21] Appl. No.: 838,825

[22] Filed: Oct. 3, 1977

[51] Int. Cl.[2] ..... F23K 3/02

[52] U.S. Cl. ..... 110/106; 110/104 R; 236/15 BA; 406/75; 432/1

[58] Field of Search ..... 432/1, 159, 175; 110/104 R, 106, 113; 236/15 BA; 302/11, 51; 222/199, 200, 478, 270, 265

[56] References Cited

U.S. PATENT DOCUMENTS

| | | | |
|---|---|---|---|
| 1,481,067 | 1/1924 | Pomeroy | 110/106 |
| 1,708,505 | 4/1929 | Jackson | 110/104 R |
| 2,233,678 | 3/1941 | Rossi | 222/200 |
| 3,033,134 | 5/1962 | Hennecke | 110/104 R |
| 3,250,843 | 9/1965 | Bogot | 110/106 |
| 3,431,597 | 3/1969 | Nowak et al. | 222/478 |
| 3,504,945 | 4/1970 | Leibundgut et al. | 302/51 |
| 3,512,841 | 5/1970 | Kollasch et al. | 302/51 |
| 3,747,810 | 7/1973 | Graser | 222/198 |
| 3,822,657 | 7/1974 | Midkiff | 226/15 BA |
| 3,969,068 | 7/1976 | Miller et al. | 110/106 |
| 4,092,094 | 5/1978 | Lingl, Jr. | 432/20 |

*Primary Examiner*—Henry C. Yuen

[57] ABSTRACT

Coal particles are discharged from a hopper into a common, vibrating feed pan which, in turn, distributes the particles evenly across the surface thereof and delivers the particles along the length thereof to a metering trough positioned below and along a longitudinal axis which extends across the discharge end of the pan. The metering trough divides the volume of coal particles into a plurality of equal batches, each of which, in turn, drops into a mixing device where the particles become airborne and are delivered into a feed conduit from whence they are fed to a furnace burner. By controlling the rate of vibration of the feed pan, variables such as moisture content of the coal and/or air, particle size and BTU content of the coal can be compensated for to maintain a desired temperature within the furnace.

9 Claims, 5 Drawing Figures

COAL FIRING SYSTEMS FOR KILNS

BACKGROUND OF THE INVENTION

In the automatic feeding of solid fuel such as coal particles to kiln burners one must be ever conscious of the ultimate object, i.e. the ability to maintain the kiln at a desired operating temperature. The output of the burners is determined by basically the amount of BTU's of coal or other fuel delivered thereto.

However, the controlling of the output temperature of the burners is not as easy as may be anticipated. Several uncontrollable variables may arise which will alter the burner temperature. Such variables include moisture content of both the coal and the ambient air, grain size of the coal particles, and BTU content of the coal. As a result, known systems require manual adjustment of individual burners which must be continually monitored and adjusted to compensate for such variables. As a result, such systems are more expensive and more difficult to maintain than would be the case if a single control could be used to maintain the desired burner temperature.

SUMMARY OF THE PRESENT INVENTION

The present invention, then, is directed to a coal firing or feeding system which overcomes the problems set forth hereinabove and in general provides a system for feeding a mixture of coal particles and air to a plurality of burners. The temperature of the furnace may be maintained at a desired level by merely adjusting the speed in which the coal particles are initially introduced to the system at a single control point. Such control may be automatically varied responsive to the temperature within the kiln.

Basically the invention includes a hopper which lays a blanket of coal particles on a vibrating feeder pan which, in turn, delivers the coal particles into a metering housing. In the metering housing the total volume of coal particles are evenly divided into a plurality of coal batches, equal in number to the number of burners to be supplied. A separate mixing means receives each of the aforementioned coal batches, converts the batch into a combustible mixture of coal and air, and causes the mixture to be delivered to one of a plurality of feed conduits which feeds one of the burners of the kiln. By varying the rate of vibration of the feed pan, the rate of flow of coal particles to the metering housing may be varied responsive to increases or decreases in kiln temperature. Thus, the amount of coal introduced into the system is automatically varied by a single control in response to the kiln temperature regardless of the attendant variables in the coal. There is no need for concern over variables such as moisture content of the air and coal particles, BTU content of the coal particles, and grain size or adjusting of feeds for each burner.

It is therefore an object of the present invention to provide a coal firing system which maintains a desired kiln temperature by automatically compensating for variables in the coal supply and conditions surrounding the coal supply.

It is another object of the present invention to provide a unique coal firing system which maintains a desired temperature level within the kiln regardless of the conditions of coal by adjusting the rate of feed of the common coal supply which is metered into batches, mixed with air, and delivered to a plurality of furnace burners.

It is another object of the present invention to provide a coal firing system of the type described which includes a vibrating feed pan which delivers coal particles at a controlled rate to a metering housing in which the volume of coal particles is divided into a plurality of smaller, evenly divided batches for delivery to a plurality of burners after mixing with air.

It is yet another object of the present invention to provide a coal firing system of the type described which includes a mixing chamber for mixing coal particles and air into a combustible fuel mixture by drawing air into the coal supply using the Venturi phenomenon.

Other objects and a fuller understanding of the present invention will become apparent from reading the following detailed description of the preferred embodiment in view of the accompanying drawings in which.

DETAILED DESCRIPTION OF A PREFERRED EMBODIMENT

Figure 1:
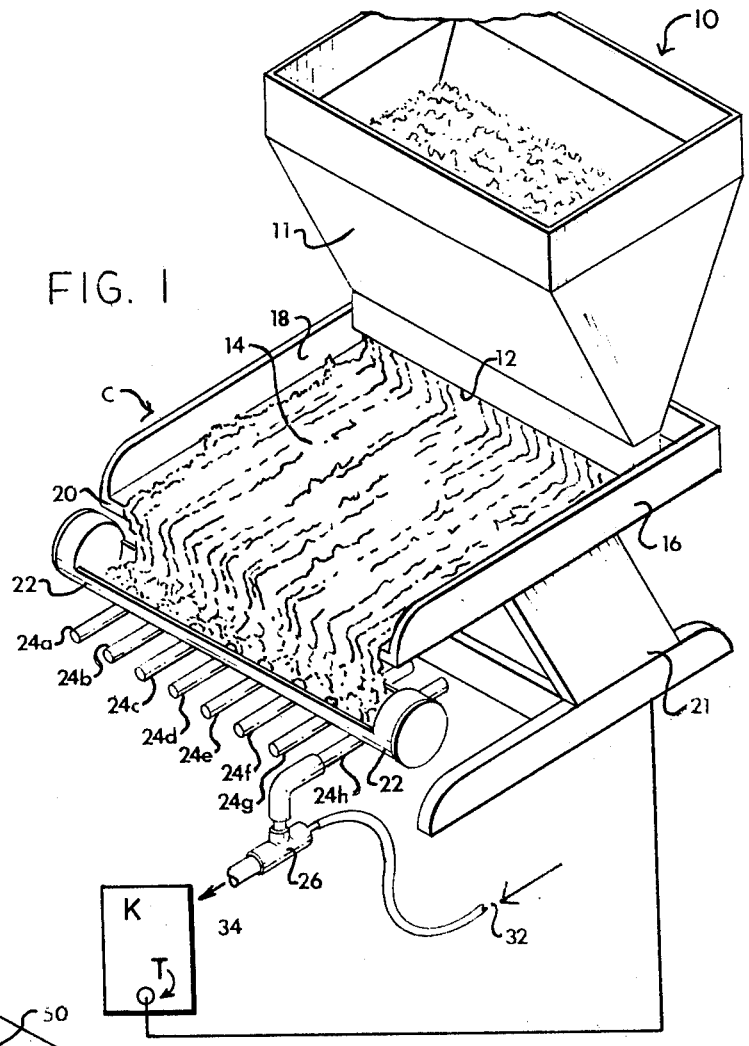
FIG. 1 is a perspective view of the coal firing system, with parts broken away, of the present invention.

Turning now to the drawings, and particularly to FIG. 1, the system according to the present invention basically includes a hopper or reservoir 10 into which finely ground coal particles are initially deposited or loaded; a feeder pan or plate 14 onto which the coal particles drop; a metering housing 20 which receives the coal particles from the feeder pan 14 and divides the coal particles into batches corresponding in number to the burners to be fed; a plurality of inlet pipes also corresponding in number to the burners to be fed, each inlet pipe 24 receiving one batch of coal particles from the metering housing 22; a mixing chamber 28 into which the inlet pipe leads including a source of forced air 32 feeding into the mixing chamber 28 and causing the inducement of a Venturi effect in inlet pipe 24 which draws in air from the open end thereof, whereupon the air mixes with the coal particles in the inlet pipe and mixing chamber 28 before being delivered to the kiln burners by a feed conduit 34.

Figure 2:
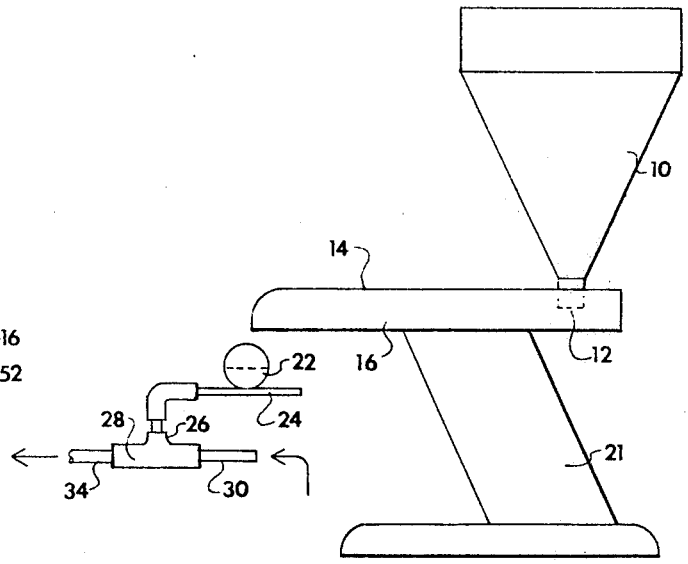
FIG. 2 is a side view of the coal firing system according to the present invention.

Turning now to a discussion of the components and their specifics, the hopper 10 is of rather conventional design having a rectangular top portion and a pair of converging side walls 11 which terminate in spaced relation to form a bottom slot 12 extending longitudinally of the hopper 10. The feeder pan 14 includes a horizontal surface beneath the outlet 12 of trough 10. Side walls 16 and 18 prevent any particles of coal from dropping off the side thereof, and a vibrator mechanism 21 of conventional, commercially available design is so connected to pan 14 as to urge the coal particles gradually forward to the terminal edge 20 of feeder pan 14. One type of commercially available vibrator mechanism is the Syntron vibrating feeder manufactured and offered for sale by FMC Corp. The bottom edge of hopper 10 which forms outlet 12 is initially positioned approximately two inches above the feeder pan 14, so that the coal proceeds toward the terminal edge 20 with a height on the pan of no more than two inches. The continual vibration causes the coal to form a mat of consistent height across the width of pan 14 until it drops into the metering housing 22 (see FIG. 2). Although a vibrating type feeder is preferred, other types of conveyances could be used, the speed of which can be controlled to deliver more or less coal particles to the exit end 20.

Figure 4:
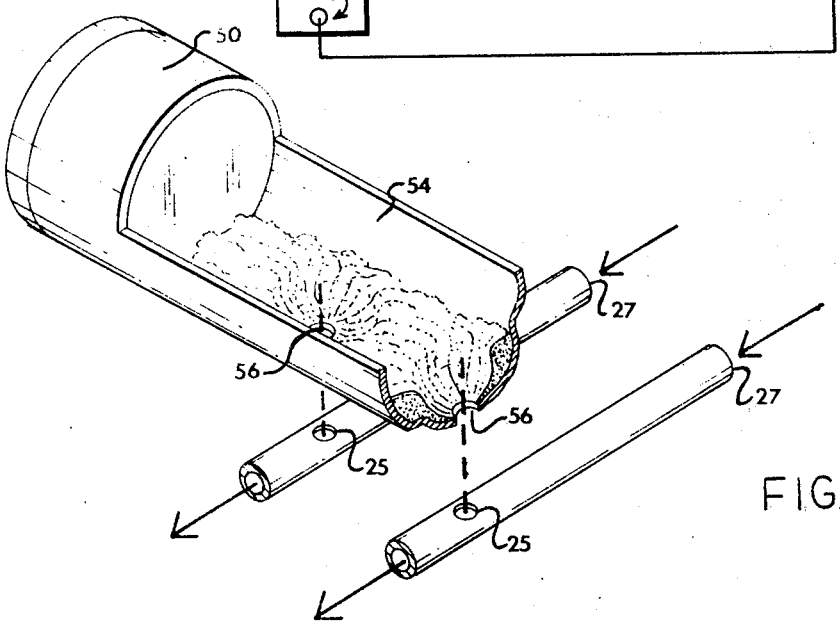
FIG. 4 is an exploded view in perspective of the metering trough and the input pipe of the mixing chamber.
Figure 3:
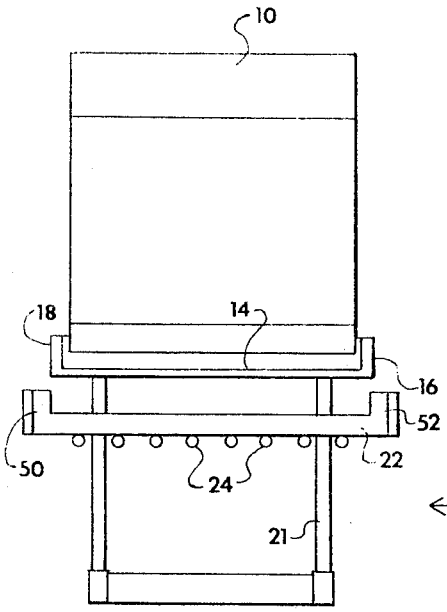
FIG. 3 is a front view of the coal firing system according to the present invention.

The metering housing 22 is best shown in FIGS. 3 and 4, and includes a pair of end walls 50,52 having a semicircular trough 54 extending therebetween. Trough 54 is at least as long as the feeder pan 14 is wide so that all of the coal which falls from the terminal edge of the feeder pan 14 drops into trough 54. A plurality of relatively small feed openings 56 are positioned in equally spaced relation across the bottom of trough 54. As the coal is initially dumped into the trough 54, there forms a small conical deposit of coal between each opening 56, the size of which is determined by the angle of repose of the coal. Thereafter, any coal deposited in the trough, feeds down into one of the openings 56, so that the coal supply is divided into a number of equal batches. Further, the number of openings 56 in the bottom of the trough correspond to the number of burners, and thus to the number of inlet pipes 24 and feed conduits 34 to be fed by the system.

An inlet or intake pipe 24 extends in generally perpendicular direction from a point below each outlet 56, and includes an upper opening 25 corresponding in size and shape to the corresponding feed opening 56, so that the coal particles dropped through opening 56 are received within the feeder pipe 24 through opening 25. The rear end 27 of feeder pipe 24 is open to the atmosphere for reasons to be described hereinafter. The opposite or forward end of the inlet pipe 24 forms a 90° (FIG. 1) and empties into an inlet 26 to mixing chamber 28. This will be described more in detail in connection with the description of FIG. 5.

Figure 5:
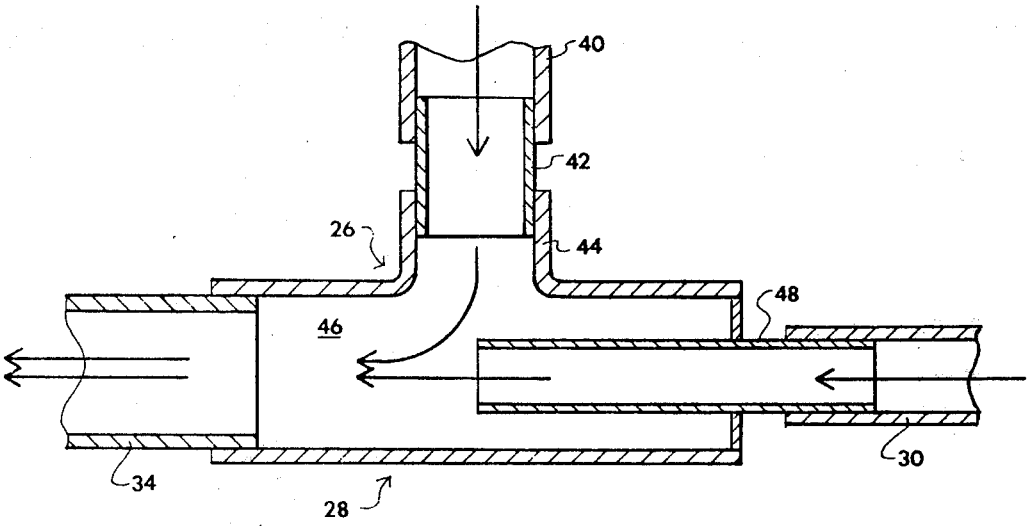
FIG. 5 is an enlarged, sectional view of the mixing chamber in which the Venturi effect is induced.

Turning now to FIG. 5, there is shown at the top thereof the lower end 40 of inlet pipe 24 which brings the coal from the metering housing 22 and inspirated air from the rear end 27 of pipe 24. A short adapter 42 joins the lower end 40 of input pipe to the nipple 44 which forms the intake opening for the mixing chamber 28. The rear end of mixing chamber 28 receives pressurized air through an adapter 48 from an air conduit 30 leading from a source of pressurized air such as an air cylinder 32 or the like. The introduction of pressurized air into the interior 46 mixing chamber 28 creates a Venturi effect as illustrated by the arrows in FIG. 5 which pulls in air through the rear end 27 of input pipe 24 and draws the coal and inspirated air into the interior 46 of mixing chamber 28 where the air and coal form a combustible mixture which is delivered to one of the burners of the kiln through feed conduit 34.

As stated hereinabove, there is provided an input pipe **24*a*–24*h* for each burner of the kiln K. By means of one or more thermostats T or thermocouples within the kiln, which are electrically connected to the vibrating mechanism 21, when the temperature within the kiln falls below a prescribed limit, the speed of vibrations can be automatically increased to deliver more coal into the metering housing, which will inherently result in more BTU's per unit time being delivered into the kiln which will cause a warmer temperature therein. On the other hand, when the temperature rises above a prescribed limit, the vibrating mechanism 21** can be signaled and controlled to slow down, thereby ultimately decreasing the temperature within the kiln. It can easily be seen then that the temperature within the kiln directly controls the feed of coal thereinto, which is automatically evenly divided by means of the metering housing, so that the one single control maintains the temperature within the kiln within prescribed limits.

Although a preferred embodiment has been described hereinabove, it is apparent that various changes and modifications might be made to the structure of the coal firing system without departing from the scope of the invention which is set forth in the following claims.

What is claimed is:

1. A coal feeding system for mixing finely ground coal particles with air to form a combustible mixture of coal and air and deliverying said mixture to a plurality of furnace burners, said system comprising:

(a) a hopper for receiving and storing a supply of said coal particles;

(b) a feeder means including a plate having a front end and rear end with the rear end positioned below the outlet of said hopper, conveying means for evenly distributing the coal particles at a substantially consistent height across said plate and moving said particles toward the front end thereof;

(c) a metering housing including a trough having an open top and positioned below the front end of said plate for receiving coal particles as they drop therefrom;

(d) said trough having a plurality of spaced openings across the bottom thereof corresponding in number to the number of said burners;

(e) a plurality of coal particle intake pipes, each of said pipes extending transversely to said trough and immediately beneath one of said openings in said trough and having an opening in the top surface thereof corresponding in size and shape with and communicating with said opening in said trough with which it is associated;

(f) a mixing chamber having a means for introducing a flow of air thereinto, an exit end, and an opening in the top wall thereof into which one end of at least one of said coal particle intake pipes enters, the other end of said coal particle intake pipe being open to the atmosphere;

(g) a combustible mixture feed conduit leading from the exit end of said mixing chamber to the furnace;

(h) whereby coal dust and inspirated air are drawn through the intake pipe into the mixing chamber and delivered to the furnace.

2. The coal feeding system according to claim 1 wherein, said conveying means includes a vibrator being varied responsive to the temperature within said furnace.

3. Coal feeding system for supplying coal to a plurality of furnace burners comprising:

(a) a hopper for storing coal particles and a plurality of feed conduits which feed conduits deliver a combustible mixture of said coal particles and air to said plurality of furnace burners;

(b) metering means for receiving a volume of coal particles from said hopper and dividing said volume into a plurality of coal batches substantially equal in volume and equal in number to the number of furnace burners;

(c) a plurality of mixing means downstream of said metering means and equal in number to the number of said furnace burners, each of which receives one of said coal batches, converts said batch to a combustible mixture of coal and air, and delivers said mixture to one of said feed conduits; and (d) feed means between said hopper and said metering means for deliverying said volume of coal particles at a controlled rate to said metering means responsive to the temperature within said furnace.

4. The coal feeding system according to claim 3 wherein said feed means comprises a plate having a front end and rear end with the rear end positioned below the outlet of said hopper, conveying means for evenly distributing the the coal particles across the width of said plate and moving said particles toward said front end.

5. The coal feeding system according to claim 4 wherein, said conveying means includes a vibrator being varied responsive to the temperature within said furnace.

6. The coal firing system according to claim 3 wherein said metering means comprises a trough having an open top and positioned below said feed means for receiving coal particles delivered therefrom, said trough having a plurality of spaced openings across the bottom thereof corresponding in number to the number of burners being fed.

7. The coal feeding system according to claim 6 and further including a plurality of coal particle intake pipes, each of said pipes extending transversely to said trough and immediately beneath one of said openings in said trough, and having an opening in the top surface thereof corresponding in size and shape with and communicating with the aforesaid opening in said trough.

8. The coal feeding system according to claim 7 wherein each of said mixing means includes a mixing chamber having an inlet thereinto through which a flow of air is introduced, an outlet, and an opening in the top wall thereof into which one end of one of said coal particle intake pipes enters, the other end of said coal particle intake pipe being open to the atmosphere, whereby coal particles and inspirated air are drawn through the intake pipe into the mixing chamber and delivered to one of the furnace burners.

9. A method of supplying coal to a plurality of furnace burners so as to maintain an even, controlled temperature within said furnace comprising the steps of:

(a) delivering a supply of coal sufficient for a plurality of burners to a metering housing;

(b) dividing said supply of coal particles into a plurality of coal particle batches substantially equal in volume and equal in number to the number of furnace burners;

(c) introducing each batch of said coal particles at a controlled rate into a confined air stream to form a mixture of coal particles and air;

(d) delivering said mixture to one of said fuel burners;

(e) varying the quantity of coal delivered to the metering housing in step (a) responsive to the temperature within the furnace.

* * * * *